US008362859B2

(12) United States Patent
Pearce et al.

(10) Patent No.: US 8,362,859 B2
(45) Date of Patent: Jan. 29, 2013

(54) MAGNETICALLY-TRIGGERED PROXIMITY SWITCH

(75) Inventors: Joel Pearce, Louisville, KY (US); Robert L. LaFountain, Charlestown, IN (US); Michael J. Simmons, Louisville, KY (US)

(73) Assignee: General Equipment and Manufacturing Company, Inc., Louisville, KY (US)

( * ) Notice: Subject to any disclaimer, the term of this patent is extended or adjusted under 35 U.S.C. 154(b) by 0 days.

(21) Appl. No.: 13/159,263

(22) Filed: Jun. 13, 2011

(65) Prior Publication Data

US 2012/0007702 A1 Jan. 12, 2012

Related U.S. Application Data

(60) Provisional application No. 61/354,170, filed on Jun. 11, 2010.

(51) Int. Cl.
*H01H 9/00* (2006.01)

(52) U.S. Cl. ..... 335/205; 335/207

(58) Field of Classification Search ..... 335/205–207
See application file for complete search history.

(56) References Cited

U.S. PATENT DOCUMENTS 4,117,431 A * 9/1978 Eicher ..... 335/207
4,674,338 A 6/1987 Carpenter
4,837,539 A * 6/1989 Baker ..... 335/207
2002/0149454 A1 10/2002 Nishikawa
2008/0266035 A1 10/2008 Rohrig et al.

FOREIGN PATENT DOCUMENTS

DE 70 07 531 8/1970
DE 33 40 419 A1 5/1985
EP 0 320 112 A2 6/1989
FR 2 386 121 10/1978

OTHER PUBLICATIONS

International Search Report and Written Opinion for corresponding International application No. PCT/US2011/038949, dated Sep. 2, 2011.

* cited by examiner

*Primary Examiner* — Ramon Barrera
(74) *Attorney, Agent, or Firm* — Marshall, Gerstein & Borun LLP

(57) ABSTRACT

A magnetically-triggered proximity switch includes a cylindrical switch body and a first magnet non-movably secured within the switch body. The proximity switch also includes a pivoting cross arm. A second magnet may be movably disposed within the switch body, and the second magnet may be rigidly connected to the cross arm. When a magnetic target is not located within a specified range of the second magnet, the first magnet attracts the second magnet, thereby pivoting the cross arm into a first switch position and closing a first circuit. However, when the magnetic target is located within the specified range, the magnetic attraction between the target and the second magnet is greater than between the second magnet and the first magnet. The second magnet is displaced towards the target away from the first magnet, thereby pivoting the cross arm into a second switch position.

19 Claims, 5 Drawing Sheets

MAGNETICALLY-TRIGGERED PROXIMITY SWITCH

FIELD OF THE DISCLOSURE

This disclosure relates generally to proximity switches, and, more particularly, to miniature magnetically-triggered proximity switches.

BACKGROUND

Magnetic proximity switches, also known as limit switches, are commonly used for linear position sensing. Typically, magnetically-triggered proximity switches include a sensor that is adapted to detect the presence of the target without physically contacting the target. Typically, the sensor may include a switching circuit mechanism enclosed within a switch body, and the switching circuit mechanism typically includes multiple levers and contacts that are biased into a first position by one or more springs. When the target, which generally includes a permanent magnet contained within a housing, passes within a predetermined range of the sensor, the magnetic flux generated by the target magnet triggers the switching circuit mechanism, thereby closing a normally open circuit. The closing of the normally open circuit is detected by a processor, and a signal is sent to an operator or an automated operation system to indicate the presence of the target within the predetermined range of the sensor. The target is typically secured to a displaceable element of a system, such as a valve stem, and the sensor is typically secured to a stationary element of a system, such as a valve body. When so configured, the sensor can detect when the displaceable element has changed positions. However, due to the relatively large physical size of the sensor necessary to enclose the switching circuit mechanism, typical sensors cannot be use in applications requiring the placement of the sensor in an area having limited free space. In addition, the need to provide power to the sensor also limits the applications in which the sensor can be used.

BRIEF SUMMARY OF THE DISCLOSURE

In accordance with one exemplary aspect of the present invention, a magnetically-triggered proximity switch includes a switch body and a first magnet non-movably secured within the switch body. A common arm having a first end and a second end is also included, and the second end is disposed within the switch body. The proximity switch also includes a primary arm having a first end and a second end. The second end is disposed within the switch body, and the second end includes a primary contact. In addition, the proximity switch includes a secondary arm having a first end and a second end. The second end is disposed within the switch body, and the second end also includes a secondary contact. The proximity switch also includes a cross arm disposed within the switch body. The cross arm has a first end and a second end, the first end being coupled to the common arm and the second end including a common contact. The proximity switch further includes a second magnet disposed within the switch body, and the second magnet is movable relative to the first magnet. The second magnet is coupled to the cross arm such that movement of the second magnet causes a corresponding movement of the cross arm between a first switch position and a second switch position. In the first switch position, the common contact of the cross arm is in contact with the primary contact of the primary arm, thereby completing a circuit between the common arm and the primary arm. In the second switch position, the common contact of the cross arm is in contact with the secondary contact of the secondary arm, thereby completing a circuit between the common arm and the secondary arm.

In another embodiment, the first magnet and the second magnet are selected to create a first magnetic force between the first magnet and the second magnet, and the first magnetic force maintains the cross arm in the first switch position. In addition, the second magnet and a target outside of the switch body are selected to create a second magnetic force between the second magnet and the target, and the second magnetic force causes the cross arm to move from the first switch position to the second switch position if the second magnetic force is greater than the first magnetic force.

In a further embodiment, when the second magnetic force between the target and the second magnet becomes weaker than the first magnetic force between the first magnet and the second magnet, the first magnetic force causes the cross arm to move from the second switch position to the first switch position.

In a still further embodiment, the first end of the cross arm is pivotably coupled to the second end of the common arm, and the movement of the second magnet relative to the first magnet causes the cross arm to rotate from the first switch position to the second switch position or from the second switch position to the first switch position. In addition, an elongated actuator arm may couple the second magnet to the common arm. The actuator arm may further be disposed within an aperture formed in the first magnet.

In another embodiment, the first end of each of the common arm, the primary arm, and the secondary arm is disposed outside of the switch body. In addition, the switch body may be cylindrical, and may be comprised of a high-temperature material. Moreover, the switch body may be comprised of plastic, and the switch body may be hermetically sealed.

In accordance with another exemplary aspect of the present invention, a method of detecting a target by a magnetically-triggered proximity switch includes providing a switch body and disposing a second end of a common arm within the switch body. In addition, a primary contact of a primary arm is disposed within the switch body, and a secondary contact of a secondary arm is disposed within the switch body. The method also includes movably coupling a cross arm having a common contact to the common arm and coupling a second magnet to the common arm. A stationary first magnet is positioned within the switch body adjacent to the second magnet, and the common contact of the cross arm is biased into contact with the primary contact by the force of the first magnet acting on the second magnet. The method further includes positioning a target at a first location outside of the switch body such that the magnetic force between the target and the second magnet is greater than the magnetic force between the first magnet and the second magnet, thereby moving the cross arm such that the common contact disengages from the primary contact and engages with the secondary contact.

In another embodiment, the method also includes positioning the target at a second location outside of the switch body such that the magnetic force between the target and the second magnet is less than the magnetic force between the first magnet and the second magnet, thereby moving the cross arm such that the common contact disengages from the secondary contact and engages with the primary contact.

In a further embodiment, the cross arm is pivotally coupled to the second end of the common arm such that the cross arm pivots to disengage the common contact from the primary contact and to engage the common contact with the secondary contact.

In a still further embodiment, when the common contact engages the primary contact, a closed circuit is formed between the common arm and the primary arm, and when the common contact engages the secondary contact, a closed circuit is formed between the common arm and the secondary arm.

In an additional embodiment, the method includes disposing a first end of each of the common arm, the primary arm, and the secondary arm outside of the switch body. In addition, the method may include hermetically sealing the switch body.

DETAILED DESCRIPTION

Figure 1A:
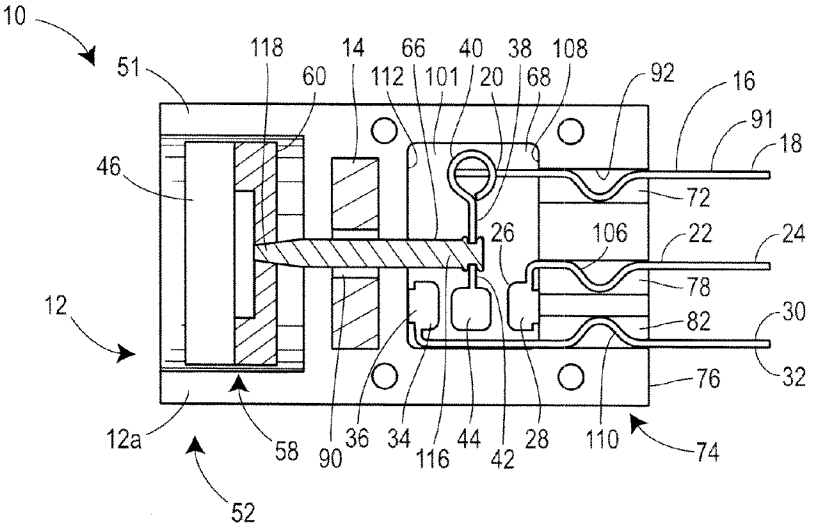
FIG. 1A is a top semi-sectional view of an embodiment of a magnetically-triggered proximity switch.
Figure 6A:
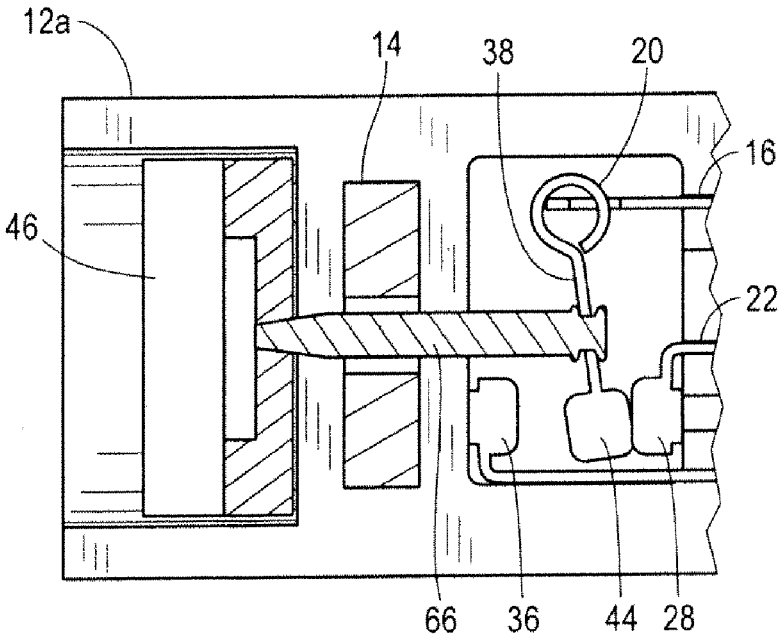
FIG. 6A is semi-sectional view of an embodiment of a magnetically-triggered proximity switch in a first switch position.
Figure 6B:
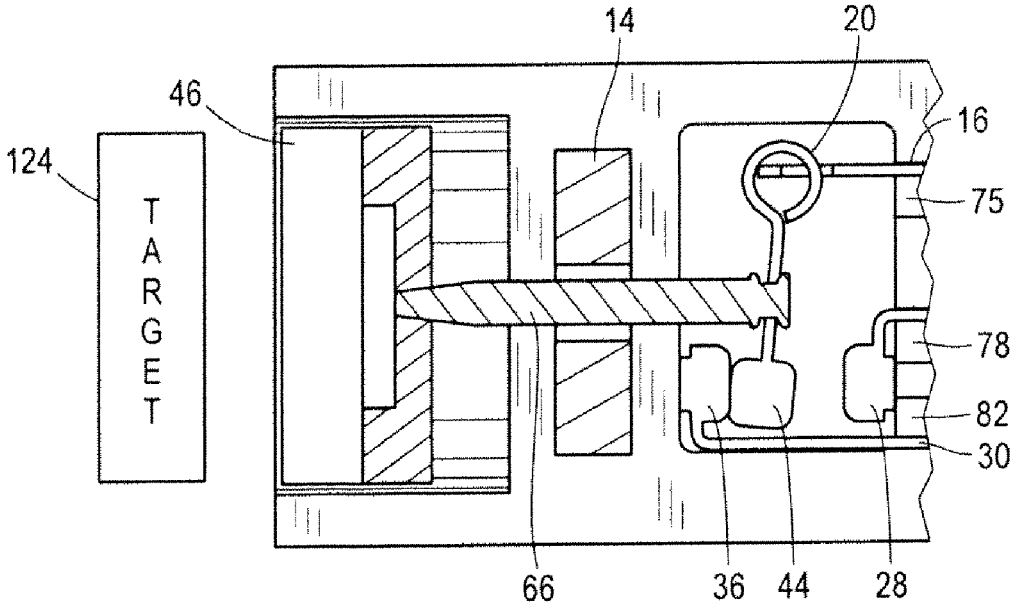
FIG. 6B is semi-sectional view of an embodiment of a magnetically-triggered proximity switch in a second switch position.

As illustrated in FIG. 1A, a magnetically-triggered proximity switch 10 includes a switch body 12 and a first magnet 14 non-movably secured within the switch body 12. The proximity switch 10 also includes a common arm 16 having a first end 18 and a second end 20, and the second end 20 of the common arm 16 is disposed within the switch body 12. The proximity switch 10 further includes a primary arm 22 having a first end 24 and a second end 26. The second end 26 is disposed within the switch body 12, and the second end 26 includes a primary contact 28. In addition, the proximity switch includes a secondary arm 30 having a first end 32 and a second end 34. The second end 34 is disposed within the switch body 12, and the second end 34 includes a secondary contact 36. A cross arm 38 is disposed within the switch body 12, and the cross arm 38 has a first end 40 and a second end 42. The first end 40 is coupled to the common arm 16 and the second end 42 includes a common contact 44. A second magnet 46 is disposed within the switch body 12, and the second magnet 46 is movable relative to the first magnet 14. Specifically, the second magnet 46 is coupled to the cross arm 38 such that movement of the second magnet 46 causes a corresponding movement of the cross arm 38 between a first switch position and a second switch position. In the first switch position, illustrated in FIG. 6A, the common contact 44 of the cross arm 38 is in contact with the primary contact 28 of the primary arm 22, thereby completing a circuit between the common arm 16 and the primary arm 22. In the second switch position, shown in FIG. 6B, the common contact 44 of the cross arm 38 is in contact with the secondary contact 36 of the secondary arm 30, thereby completing a circuit between the common arm 16 and the secondary arm 30.

Figure 1B:
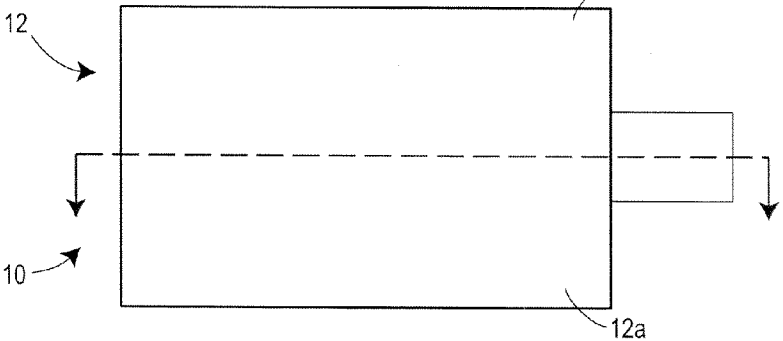
FIG. 1B is a side view of the embodiment of FIG. 1A.
Figure 1C:
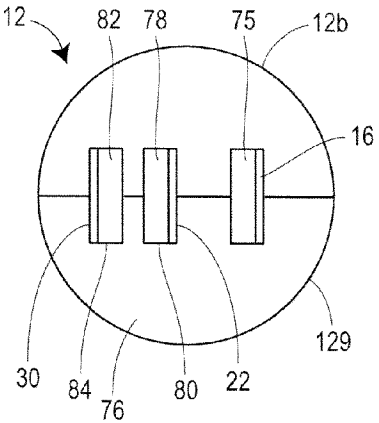
FIG. 1C is a rear view of the embodiment of FIG. 1A.
Figure 3:
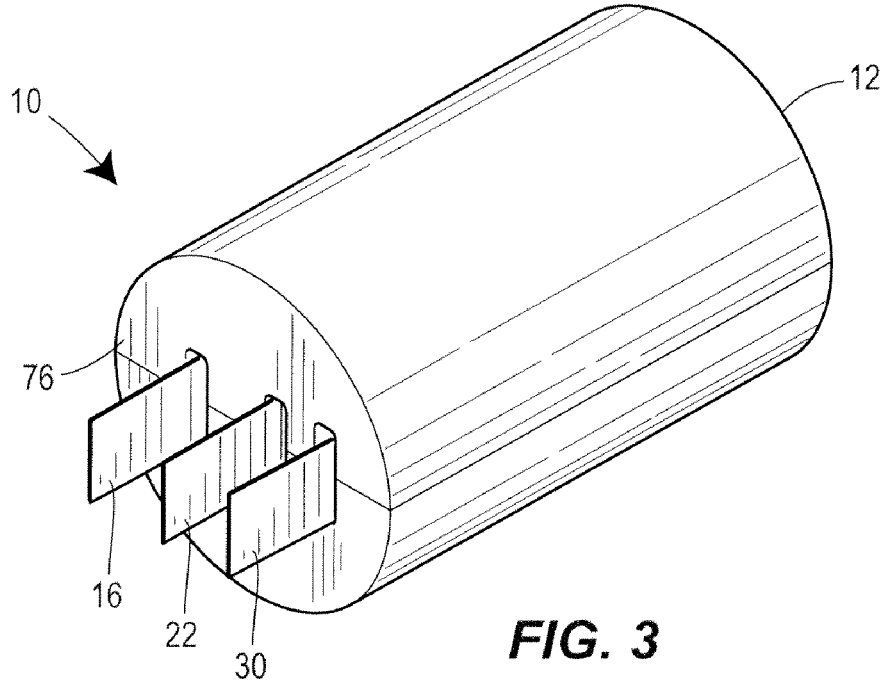
FIG. 3 is perspective view of an embodiment of a magnetically-triggered proximity switch.

FIG. 1A shows a cross-sectional view of the switch body 12 of the magnetically-triggered proximity switch 10. The switch body 12 preferably has a generally cylindrical shape having a circular cross-section. However, the switch body 12 may have any cross-sectional shape, such as a polygon or an oval, for example. The switch body 12 may include a first body half 12*a* and a second body half 12*b*. Because the second body half 12*b* may be identical to the first body half 12*a*, only the first body half 12*a* is illustrated. Each of the first body half 12*a* and the second body half 12*b* may be formed from plastic and may be manufactured using conventional processes, such as injection-molding, for example. The plastic may be a high-temperature material that allows the switch body 12 to be exposed to environments that may damage conventional plastic materials. The first body half 12*a* and the second body half 12*b* may be joined into a single switch body 12, as illustrated in FIGS. 1B, 1C and 3, using any of several methods known in the art, such as ultrasonic welding or by using an adhesive. Additionally, the switch body 12 may be hermetically sealed to protect the protect the proximity switch from water or dirt particles. However, the switch body 12 may be made of any suitable material and may be manufactured by any means known in the art.

Figure 4:
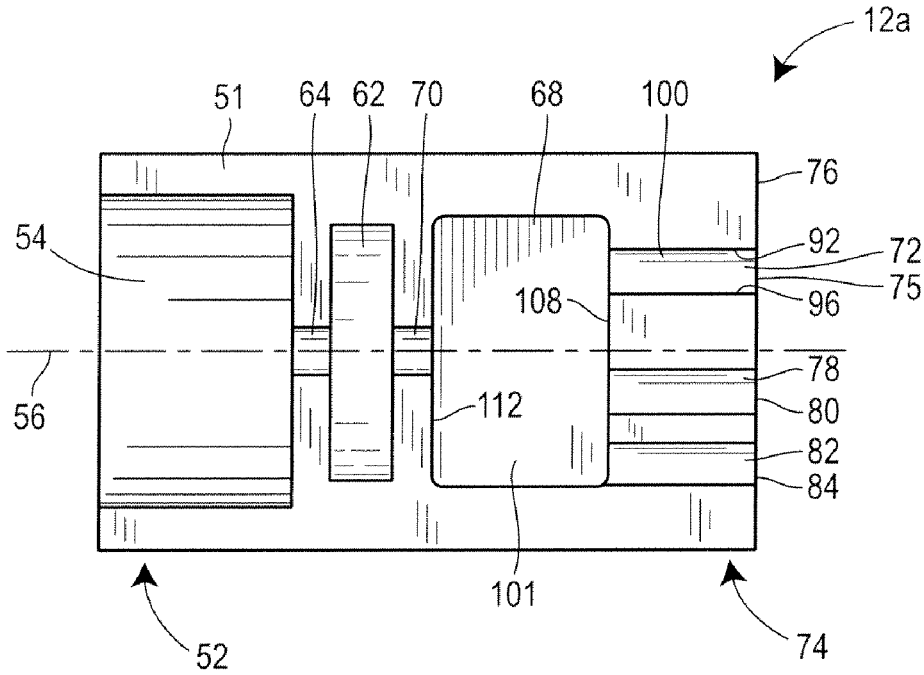
FIG. 4 is top view of a first body half of an embodiment of a magnetically-triggered proximity switch.

As illustrated in FIGS. 1A and 4, the semi-cylindrical first body half 12*a* of the switch body 12 may have a substantially planar mating surface 51 that is adapted to engage a corresponding mating surface (not shown) of the second body half 12*b* to form the switch body 12. The first body half 12*a* also includes an open first end 52 that includes a semi-cylindrical second magnet cavity 54, and the second magnet cavity 54 may inwardly extend along a longitudinal axis 56 of the body 12 that extends along the plane of the mating surface 51. The second magnet cavity 54 may be sized to receive a detector magnet assembly 58, illustrated in FIG. 2, that includes the disk-shaped second magnet 46 and a magnet base 60 coupled to the second magnet 46, and the detector magnet assembly 58 may slidably displace within the second magnet cavity 54 along the longitudinal axis 56.

A semi-cylindrical first magnet cavity 62 may also be formed in the first body half 12*a* to receive and secure the first magnet 14 within the body such that a longitudinal axis of the disk-shaped first magnet 14 is substantially aligned with the longitudinal axis 56 of the first body half 12*a*. A semi-cylindrical upper arm cavity 64 may extend along the longitudinal axis 56 between the second magnet cavity 54 and the first magnet cavity 62, and the upper arm cavity 64 may be sized to receive an elongated actuator arm 66 that extends between the cross-arm 38 and the magnet base 60. A generally rectangular contact cavity 68 may be formed in the first body half 12*a* to receive the second end 20 of the common arm 16, the second end 26 of the primary arm 22, the second end 34 of the secondary arm 30, the cross arm 38, and a first end 116 of the actuator arm 66. A semi-cylindrical lower arm cavity 70 may extend along the longitudinal axis 56 between the first magnet cavity 62 and the contact cavity 68, and the lower arm cavity 70 may be sized to receive the actuator arm 66. A rectangular common slot 72 may extend from the contact cavity 68 to a second end 74 of the first body half 12*a* in a direction generally parallel to the longitudinal axis 56 such that the common slot 72 forms a common aperture 75 in a rear face 76 of the first body half 12*a*. The common slot 72 may be sized to receive the common arm 16 such that the first end 18 of the common arm 16 extends through the common aperture 75 formed in the rear face 76. A rectangular primary slot 78 may extend from the contact cavity 68 to the second end 74 of the first body half 12*a* in a direction generally parallel to and offset from the common slot 72 such that the primary slot 78 forms a primary aperture 80 in the rear face 76 of the first body half 12*a*. The primary slot 78 may be sized to receive the primary arm 22 such that the first end 24 of the primary arm 22 extends through the primary aperture 80 in the rear face 76. In addition, a rectangular secondary slot 82 may extend from the contact cavity 68 to the second end 74 of the first body half 12*a* in a direction generally parallel to and offset from both the common slot 72 and the primary slot 78 such that the secondary slot 82 forms a secondary aperture 84 in the rear face 76 of the first body half 12*a*. The secondary slot 82 may be sized to receive the secondary arm 32 such that the first end 32 of the secondary arm 32 extends through the secondary aperture 84 in the rear face 76.

As discussed above and as illustrated in FIGS. 1A and 2, the magnetically-triggered proximity switch 10 also includes a detector magnet assembly 58 slidably disposed within the second magnet cavity 54 of the first body half 12*a* and the second body half 12*b* of the switch body 12. The detector magnet assembly 58 may include a second magnet 46, also called a detector magnet, that may be cylindrical in shape. Preferably, the second magnet 46 has the shape of a disk. The second magnet 46 may be a permanent magnet or any other type of suitable magnet. The detector magnet assembly 58 may also include a magnet base 60 that may have a planar bottom portion 86 and a circumferential side wall 88 that extends away from the bottom portion 86. The bottom portion 86 and side wall 88 may be dimensioned to receive the second magnet 46 such that a planar surface of the second magnet 46 is proximate to the top of the side wall 88 and the outside radius of the second magnet 46 is slightly less than the inner radius of the side wall 88. The magnet base 60 may be made from a metal, such as stainless steel, and the second magnet 46 may be secured to the magnet base 60 by a magnetic force. Alternatively, the magnet base 60 may be made from a non-magnetic material, and the second magnet 46 may be mechanically or adhesively secured to the magnet base 60.

Referring again to FIGS. 1A and 2, the magnetically-triggered proximity switch 10 further includes a first magnet 14, also called a bias magnet. The first magnet 14 may be cylindrical in shape, and may have the shape of a disk. The first magnet 14 may also have an aperture 90 formed along the central longitudinal axis of the first magnet 14, and the aperture 90 may be sized to receive the actuator arm 66. The first magnet 14 may be received into the first magnet cavity 62 of the switch body 12 such that the first magnet 14 cannot displace when the first body half 12*a* and the second body half 12*b* are joined together to form the switch body 12. The first magnet 14 may be made from the same material as the second magnet 46, but the radius and the thickness of the first magnet 14 may each be smaller than the respective radius and thickness of the second magnet 46. The first magnet 14 may be positioned within the first magnet cavity 62 such that the second magnet 46 is attracted towards the first magnet 14. That is, if a north pole of the second magnet 46 faces the second end 74 of the switch body 12, a south pole of the first magnet 14 is disposed facing the north pole of the second magnet 46. Conversely, if a south pole of the second magnet 46 faces the second end 74 of the switch body 12, a north pole of the first magnet 14 is disposed facing the south pole of the second magnet 46.

Figure 2:
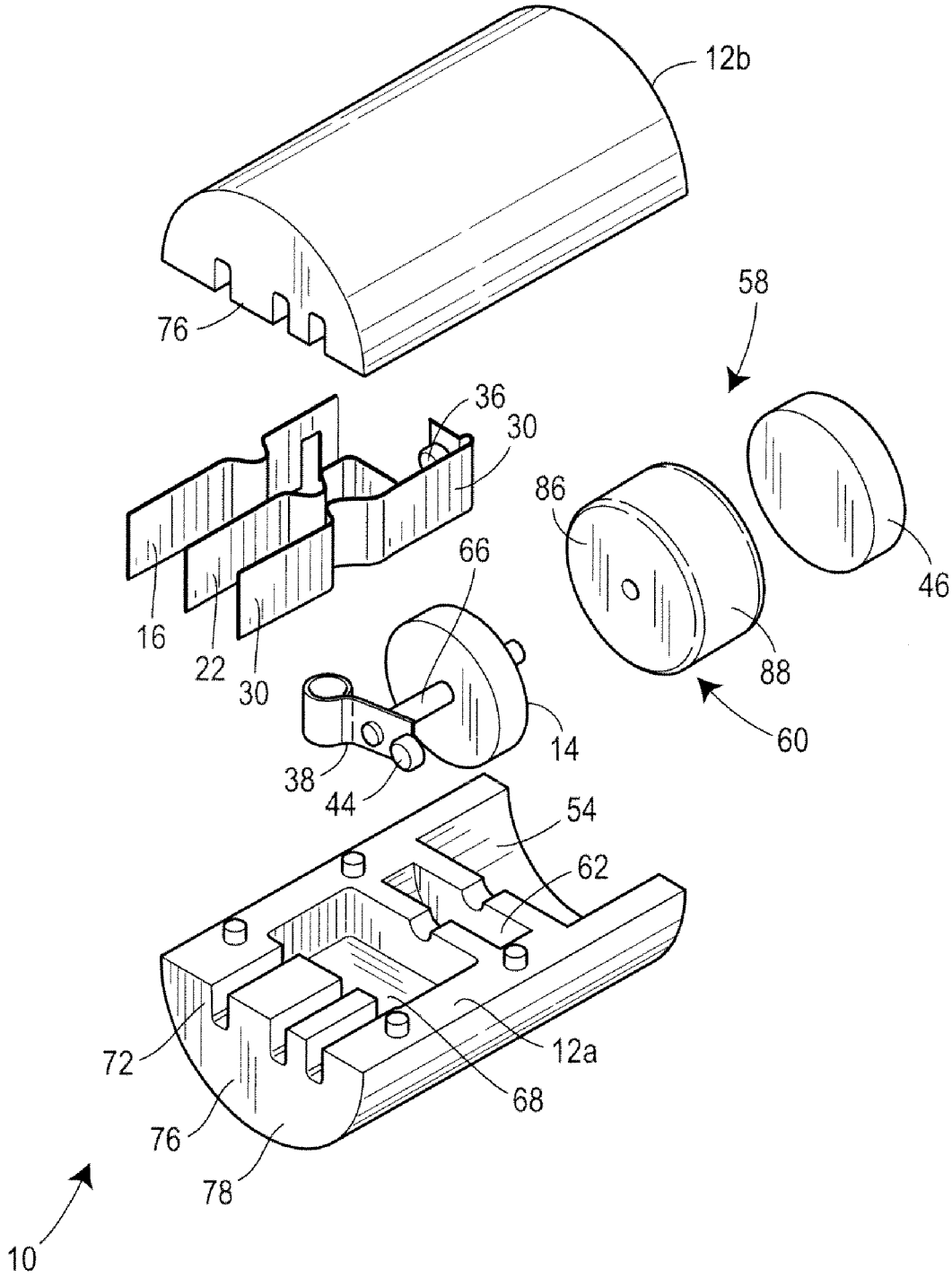
FIG. 2 is an exploded perspective view of an embodiment of a magnetically-triggered proximity switch.
Figure 5A:
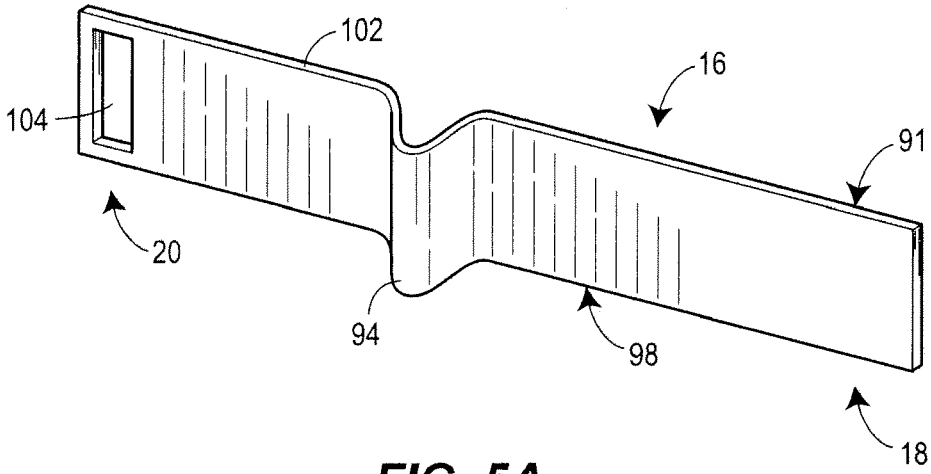
FIG. 5A is perspective view of a common arm of an embodiment of a magnetically-triggered proximity switch.

Referring to FIGS. 1A, 2, and 5A, the magnetically-triggered proximity switch 10 also includes a common arm 16, which is a common component of the circuit formed by the first switch position and the circuit formed by the second switch position. The common arm 16 may be a narrow strip of a conducting metal, such as copper or a copper alloy, and the common arm 16 may be formed from a stamping process. As discussed above, the second end 20 of the common arm 16 is disposed within the contact cavity 68 such that common arm 16 extends through the common slot 72 formed in the switch body 12, and the first end 18 protrudes through the common aperture 75 to a position outside of the switch body 12. The common arm 16 may be positioned within the common slot 72 such a longitudinal axis of the common arm 16 is parallel to the longitudinal axis 56 of the switch body 12, while in a transverse direction, the common arm 16 is perpendicular to the plane passing through the mating surface 51 of the first body half 12*a*. A rear surface 91 of the common arm 16 may contact a first wall 92 of the common slot 72, the first wall 92 being longitudinally aligned with the common arm 16 and perpendicular to the plane of the mating surface 51, as shown in FIG. 4. A portion of the common arm 16 disposed within the common slot 72 may be curved, and a top surface of the curved portion 94 may contact a second wall 96 forming the common slot 72, the second wall 96 being offset from and parallel to the first wall 92. Because the transverse distance between the top surface of the curved portion 94 and the rear surface 91 of the common arm 16 is greater than the distance between the first wall 92 and second wall 96 of the common slot 72, an interference fit is provided that secures the common arm 16 within the common slot 72. A bottom surface 98 of the common arm 16 may contact a third wall 100 forming the common slot 72 of the first body half 12*a*, the third wall 100 being perpendicular to the first wall 92 and the second wall 96, and a top surface 102 of the common arm 16 may contact a fourth wall (not shown) of the corresponding common slot 72 of the second body half 12*b* when the first body half 12*a* and the second body half 12*b* are assembled into the switch body 12. Because the third wall 100 of the common slot 72 is closer to the plane formed by the mating surface 51 than a bottom surface 98 of the contact cavity 68, a gap exists between the bottom surface 101 of the common arm 16 and the bottom surface 101 of the contact cavity 68 of the first body half 12*a*. Similarly, a gap exists between the top surface 102 of the common arm 16 and the top surface (not shown) of the contact cavity 68 of the second body half 12*b*. The common arm 16 may also include a transverse slot 104 that extends across the width of the common arm 16 proximate to the second end 20.

Referring to FIGS. 1A and 2, the magnetically-triggered proximity switch 10 also includes a primary arm 22. The primary arm 22 may be made from the same material as the common arm 16, and the primary arm 22 may engage the primary slot 78 in the same manner that the common arm 16 engages the common slot 72. Accordingly, a curved portion 106 of the primary arm 22 provides an interference fit within the primary slot 78 to retain the primary arm 22 within the primary slot 78. In addition, the first end 24 of the primary arm 22 extends from the primary aperture 80 formed in the rear face 76 of the switch body 12 such that when viewed normal to the mating surface 51, the first end 24 of the primary arm 22 is parallel to the first end 18 of the common arm 16. The second end 26 of the primary arm 22 is coupled to a primary contact 28. The primary contact 28 may be made from a conductive metal, such as copper or a copper alloy, and the primary contact 28 may be secured to the primary arm 22 in any manner known in the art, such as soldering or mechanical fastening. Alternatively, the primary contact 28 may be integrally formed with the second end 26 of the primary arm 22. The primary contact 28 may be disposed proximate to a first cavity wall 108 that partially defines the contact cavity 68.

Referring again to FIGS. 1A and 2, the magnetically-triggered proximity switch 10 also includes a secondary arm 30. The secondary arm 30 may be made from the same material as the common arm 16, and the secondary arm 30 may engage the secondary slot 82 in the same manner that the common arm 16 engages the common slot 72. However, the secondary arm 30 may be positioned within the secondary slot 82 in a "mirror image" relationship with the primary arm 22 in the primary slot 78. More specifically, a top surface of the curved portion 110 of the secondary arm 30 may face a top surface of the curved portion 106 of the primary arm 22. As configured, the first end 32 of the secondary arm 30 extends from the secondary aperture 84 formed in the rear face 76 of the switch body 12 such that when viewed normal to the mating surface 51, the first end 32 of the secondary arm 30 is parallel to both the first end 24 of the primary arm 22 and the first end 18 of the common arm 16. The second end 34 of the secondary arm 30 is coupled to a secondary contact 36. Similar to the primary contact 28, the secondary contact 36 may be made from a conductive metal, such as copper or a copper alloy, and the secondary contact 36 may be secured to the secondary arm 30 in any manner known in the art, such as soldering or mechanical fastening. Alternatively, the secondary contact 36 may be integrally formed with the second end 34 of the secondary arm 30. The secondary contact 36 may be disposed proximate to a second cavity wall 112 of the contact cavity 68 that is offset from and parallel to the first cavity wall 108.

Figure 5B:
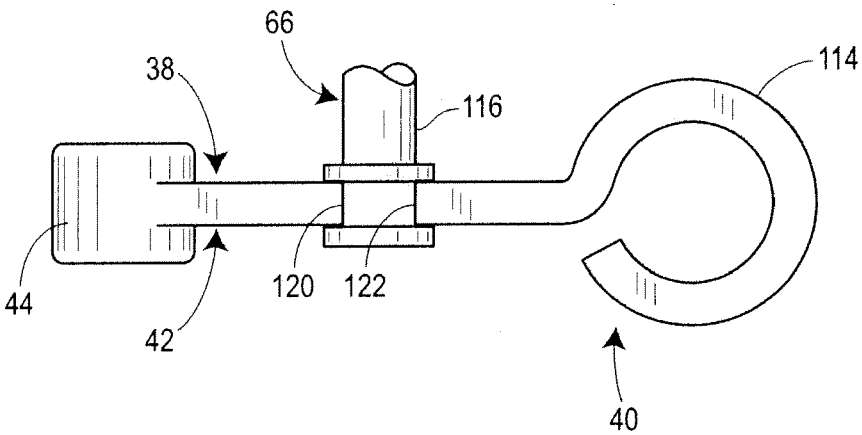
FIG. 5B is perspective view of a cross arm of an embodiment of a magnetically-triggered proximity switch.

Referring to FIGS. 1A, 2, and 5B, the magnetically-triggered proximity switch 10 also includes a cross arm 38. The cross arm 38 may be formed from a narrow strip of a conducting metal, such as copper or a copper alloy, and the common arm 16 may be formed from a stamping process and subsequent bending process. A second end 42 of the cross arm 38 may include a common contact 44. The common contact 44 may be made from a conductive metal, such as copper or a copper alloy, and the common contact 44 may be secured to the cross arm 38 in any manner known in the art, such as soldering or mechanical fastening. Alternatively, the common contact 44 may be integrally formed with the second end 42 of the cross arm 38. A first end 40 of the cross arm 38 may include an end loop 114, and a portion of the end loop 114 may be disposed within the transverse slot 104 of the common arm 16 such that the cross arm 38 may rotate about the second end 20 of the common arm 16 while maintaining contact with the common arm 16. The cross arm 38 may be rotatable about the second end 20 of the common arm 16 between a first switch position and a second switch position. In the first switch position, shown in FIG. 6A, the common contact 44 of the cross arm 38 is in contact with the primary contact 28 of the primary arm 22, thereby completing a circuit between the common arm 16 and the primary arm 22. In the second switch position, shown in FIG. 6B, the common contact 44 of the cross arm 38 is in contact with the secondary contact 36 of the secondary arm 30, thereby completing a circuit between the common arm 16 and the secondary arm 30.

Referring again to FIGS. 1A, 2, and 5B, the magnetically-triggered proximity switch 10 also includes an actuator arm 66. The actuator arm 66 may be an elongated cylinder having a first end 116 and a second end 118 opposite the first end 116. Instead of a cylinder, the actuator arm 66 hay have any suitable cross-sectional shape or combination of shapes, such as that of a square, oval, or polygon. The actuator arm 66 may be formed from a plastic material or any other suitable material. The actuator arm 66 may be slidably disposed in the upper arm cavity 64 and the lower arm cavity 70 of the switch body 12, and each of the upper arm cavity 64 and the lower arm cavity 70 may have an inner diameter that is slightly greater than the outer diameter of the actuator arm 66. The actuator arm 66 may also extend through the aperture 90 in the first magnet 14 when the first magnet 14 is disposed within the first magnet cavity 62. The first end 116 of the actuator arm 66 may include a groove 120, and the groove 120 may receive an edge portion 122 that defines the aperture in the cross arm 38 to secure the actuator arm 66 to the cross arm 38, as shown in FIG. 5B. However, the first end 116 may be coupled to the cross arm 38 by any means known in the art, such as, for example, mechanical fastening. The second end 118 of the actuator arm 66 may be coupled to the magnet base 60 of the detector magnet assembly 58 in a manner similar to the coupling of the first end 116 to the cross arm 38.

In operation, the first magnet 14 provides a magnetic force that attracts the second magnet 46. This attractive force displaces the detector magnet assembly 58 towards the first magnet 14, thereby displacing the actuator arm 66 towards the second end 74 of the switch body 12. The displacement of the actuator arm 66 rotates the cross arm 38 about the second end 20 of the common arm 16 such that the common contact 44 is in contact with the primary contact 28. In this first switch position, shown in FIG. 6A, a circuit is completed between the primary arm 22 and the common arm 16. Accordingly, the closed circuit that results from the first switch position can be detected by a processor that is operatively connected to the first end 18 of the common arm 16 and the first end 24 of the primary arm 22.

However, when a magnetic target 124, which may include a permanent magnet or a ferrous metal, is moved into a position within a predetermined range of the proximity switch 10, the magnetic force between the target 124 and the second magnet 46 may be greater than the magnetic force between the second magnet 46 and the first magnet 14. The greater force displaces the detector magnet assembly 58 towards the target 124 and away from the first magnet 14, thereby displacing the actuator arm 66 that is rigidly coupled to the magnet base 60 of the detector magnet assembly 58. As the actuator arm 66 is displaced, the cross arm 38 is rotated about the second end 20 of the common arm 16 to move the common contact 44 out of contact with the primary contact 28 and into contact with the secondary contact 36. In this second switch position, shown in FIG. 6B, a circuit is completed between the secondary arm 30 and the common arm 16. Accordingly, the closed circuit that results from the second switch position can be detected by a processor that is operatively connected to the first end 18 of the common arm 16 and the first end 32 of the secondary arm 30. When the target is no longer within the predetermined range of the proximity switch 10, the magnetic force between the first magnet 14 and the second magnet 46 becomes greater than the magnetic force between the second magnet 46 and the target 124, and the proximity switch 10 moves into the first position in the manner described above.

One having ordinary skill in the art would recognize that the magnetic force between the target 124 and the second magnet 46 can depend on several factors, such as the relative size of the target 124 and the second magnet 46 and the distance between the target 124 and the second magnet 46, and these variables can be adjusted to provide for optimal interaction between the proximity switch 10 and the target 124. In a similar manner the magnetic force between the second magnet 46 and the first magnet 14 can also be adjusted.

One having ordinary skill in the art would also recognize that the disclosed embodiments of the magnetically-triggered proximity switch 10 allows for a relatively small switch body 12 having an integrated design, which further allows the magnetically-triggered proximity switch 10 to be used in applications with limited space requirements, such as in electrical junction boxes. It is also apparent to one having ordinary skill in the art that the disclosed embodiments of the magnetically-triggered proximity switch 10, unlike typical proximity switches, do not need an external power source to function, thereby simplifying installation and extending the working life of the proximity switch 10.

While various embodiments have been described above, this disclosure is not intended to be limited thereto. Variations can be made to the disclosed embodiments that are still within the scope of the appended claims. For example, instead of the single pole/single throw configuration described, a double pole/double throw configuration is also contemplated. In addition, LEDS may be included in the housing to visually indicate whether the proximity switch is in the first switch position or the second switch position.

What is claimed is:

1. A magnetically-triggered proximity switch comprising:

a switch body;

a first magnet non-movably secured within the switch body;

a common arm having a first end and a second end, the second end being disposed within the switch body;

a primary arm having a first end and a second end, the second end being disposed within the switch body, and the second end including a primary contact;

a secondary arm having a first end and a second end, the second end being disposed within the switch body, and the second end including a secondary contact;

a cross arm disposed within the switch body, the cross arm having a first end and a second end, wherein the first end is coupled to the common arm and the second end includes a common contact;

an actuator arm having a first end and a second end opposite the first end, wherein the first end of the actuator arm is coupled to the cross arm; and a second magnet disposed within the switch body, the second magnet being movable relative to the first magnet, wherein the second magnet is coupled to the second end of the actuator arm such that movement of the second magnet causes a corresponding movement of the cross arm between a first switch position and a second switch position, and wherein the second magnet is the only magnet coupled to the actuator arm, wherein in the first switch position, the common contact of the cross arm is in contact with the primary contact of the primary arm, thereby completing a circuit between the common arm and the primary arm, and wherein in the second switch position, the common contact of the cross arm is in contact with the secondary contact of the secondary arm, thereby completing a circuit between the common arm and the secondary arm.

2. The magnetically-triggered proximity switch of claim 1, wherein the first magnet and the second magnet are selected to create a first magnetic force between the first magnet and the second magnet, and the first magnetic force maintains the cross arm in the first switch position, and wherein the second magnet and a target outside of the switch body are selected to create a second magnetic force between the second magnet and the target, and the second magnetic force causes the cross arm to move from the first switch position to the second switch position if the second magnetic force is greater than the first magnetic force.

3. The magnetically-triggered proximity switch of claim 2, wherein when the second magnetic force between the target and the second magnet becomes weaker than the first magnetic force between the first magnet and the second magnet, the first magnetic force causes the cross arm to move from the second switch position to the first switch position.

4. The magnetically-triggered proximity switch of claim 1, wherein the first end of the cross arm is pivotably coupled to the second end of the common arm, and the movement of the second magnet relative to the first magnet causes the cross arm to rotate from the first switch position to the second switch position or from the second switch position to the first switch position.

5. The magnetically-triggered proximity switch of claim 1, wherein the actuator arm is disposed within an aperture formed in the first magnet.

6. The magnetically-triggered proximity switch of claim 1, wherein the first end of each of the common arm, the primary arm, and the secondary arm is disposed outside of the switch body.

7. The magnetically-triggered proximity switch of claim 1, wherein the switch body is cylindrical.

8. The magnetically-triggered proximity switch of claim 7, wherein the switch body is comprised of a high-temperature material.

9. The magnetically-triggered proximity switch of claim 8, wherein the switch body is comprised of plastic.

10. The magnetically-triggered proximity switch of claim 9, wherein the switch body is hermetically sealed.

11. The magnetically-triggered proximity switch of claim 1, wherein the first magnet has a cylindrical shape with a diameter of the first magnet being greater than a longitudinal thickness of the first magnet.

12. The magnetically-triggered proximity switch of claim 11, wherein the second magnet has a cylindrical shape and the diameter and the longitudinal thickness of the first magnet is each smaller than a respective diameter and longitudinal thickness of the second magnet.

13. A method of detecting a target by a magnetically-triggered proximity switch comprising:

providing a switch body;

disposing a second end of a common arm within the switch body;

disposing a primary contact of a primary arm within the switch body;

disposing a secondary contact of a secondary arm within the switch body;

movably coupling a cross arm having a common contact to the common arm;

providing an elongated actuator arm having a first end and a second end, wherein the first end of the actuator arm is coupled to the cross arm;

coupling a second magnet to the second end of the actuator arm such that the second magnet is coupled to the common arm and such that the second magnet is the only magnet coupled to the actuator arm;

positioning a stationary first magnet within the switch body adjacent to the second magnet;

biasing the common contact of the cross arm into contact with the primary contact by the force of the first magnet acting on the second magnet; and positioning a target at a first location outside of the switch body such that the magnetic force between the target and the second magnet is greater than the magnetic force between the first magnet and the second magnet, thereby moving the cross arm such that the common contact disengages from the primary contact and engages with the secondary contact.

14. The method of claim 13, further comprising positioning the target at a second location outside of the switch body such that the magnetic force between the target and the second magnet is less than the magnetic force between the first magnet and the magnetic assembly, thereby moving the cross arm such that the common contact disengages from the secondary contact and engages with the primary contact.

15. The magnetically-triggered proximity switch of claim 13, wherein the cross arm is pivotally coupled to the second end of the common arm such that the cross arm pivots to disengage the common contact from the primary contact and to engage the common contact with the secondary contact.

16. The magnetically-triggered proximity switch of claim 13, wherein when the common contact engages the primary contact, a closed circuit is formed between the common arm and the primary arm, and when the common contact engages the secondary contact, a closed circuit is formed between the common arm and the secondary arm.

17. The method of claim 13, further comprising disposing a first end of each of the common arm, the primary arm, and the secondary arm outside of the switch body.

18. The method of claim 13, further comprising hermetically sealing the switch body.

19. A magnetically-triggered proximity switch comprising:

a switch body;

a first magnet non-movably secured within the switch body, wherein the first magnet has a cylindrical shape with a diameter of the first magnet being greater than a longitudinal thickness of the first magnet;

a common arm having a first end and a second end, the second end being disposed within the switch body;

a primary arm having a first end and a second end, the second end being disposed within the switch body, and the second end including a primary contact;

a secondary arm having a first end and a second end, the second end being disposed within the switch body, and the second end including a secondary contact;

a cross arm disposed within the switch body, the cross arm having a first end and a second end, wherein the first end is coupled to the common arm and the second end includes a common contact; and a second magnet disposed within the switch body, the second magnet being movable relative to the first magnet, wherein the second magnet is coupled to the cross arm such that movement of the second magnet causes a corresponding movement of the cross arm between a first switch position and a second switch position, wherein the second magnet has a cylindrical shape and the diameter and the longitudinal thickness of the first magnet is each smaller than a respective diameter and longitudinal thickness of the second magnet, wherein in the first switch position, the common contact of the cross arm is in contact with the primary contact of the primary arm, thereby completing a circuit between the common arm and the primary arm, and wherein in the second switch position, the common contact of the cross arm is in contact with the secondary contact of the secondary arm, thereby completing a circuit between the common arm and the secondary arm.

* * * * *